United States Patent [19]

Pritchett

[11] Patent Number: 4,934,298

[45] Date of Patent: Jun. 19, 1990

[54] BOAT LIFT

[75] Inventor: James A. Pritchett, Grove, Okla.

[73] Assignee: Virginia L. Pritchett, Grove, Okla.

[21] Appl. No.: 797,840

[22] Filed: Nov. 14, 1985

[51] Int. Cl.[5] ..... B63C 1/02

[52] U.S. Cl. ..... 114/44; 114/45

[58] Field of Search ..... 114/44, 45, 46, 48, 114/49, 50, 52, 344; 405/221, 3, 1, 2, 4–7

[56] References Cited

U.S. PATENT DOCUMENTS 3,626,447 12/1971 Hindlin ..... 405/221
3,857,248 12/1974 Rutter ..... 114/45 X
4,072,119 2/1978 Williams ..... 114/45

*Primary Examiner*—Joseph F. Peters, Jr.

*Assistant Examiner*—Clifford T. Bartz

*Attorney, Agent, or Firm*—Bill D. McCarthy

[57] ABSTRACT

A boat lift for raising and lowering a boat in a boat slip disposed between spaced apart parallel dock sides, the lift having a pair of cross members disposed perpendicularly to the dock sides and supporting a boat support frame. The cross members are slidably connected to parallel guide arms angularly attachable to the dock sides via adjustable dock clamps. One or more tanks are attached to the cross members for supporting same at selected heights in a body of water, and pressure hoses and valves are provided for selectively admitting compressed air or water into the tanks for raising and lowering the boat support frame relative to the water.

3 Claims, 2 Drawing Sheets

BOAT LIFT

BACKGROUND OF THE INVENTION

This invention relates to a boat lift and more particularly, but not by way of limitation, to a boat lift for attachment to spaced apart parallel sides of a boat dock and adjacent a boat slip.

Heretofore, there have been various types of boat lifts and boat hoists such as the devices found in the following United States Patent. They are U.S. Pat. No. 4,391,550, U.S. Pat. No. 3,169,644, and U.S. Pat. No. 4,072,119 and U.S. Pat. No. 3,857,248. None of the prior art patents specifically disclose the unique features and advantages of the subject boat lift.

SUMMARY OF THE INVENTION

The subject invention provides a boat lift with a dock attachment with parallel guide arms for slidably receiving the ends of tank support cross members for allowing a more even and smooth lift as the boat lift is raised and lowered in the water.

The boat lift further includes upper and lower guide stops attached to the guide arms for limiting the travel of the tank support cross members as the cross members are raised and lowered by the boat lift tanks.

The boat lift for raising and lowering a boat in a boat slip includes a pair of tank support cross members perpendicular to the dock sides and having a boat support frame thereon for supporting a boat when the lift is raised. A pair of tanks are attached to the cross members and include means for admitting compressed air into the tanks for raising the lift and valve means for admitting water into the tank for lowering the lift. The tank support cross members include collars attached at opposite ends thereof which are slidably received around guide arms. The guide arms are attached to arm holders which are secured to dock clamps attached to the dock sides. As the boat is raised and lowered the collars slide along the length of the guide arms. The guide arms further include upper and lower guide stops to control the travel of the cross members with collars attached thereto. Angle braces are attached to the bottom of the guide arms and are parallel to the sides of the dock.

The advantages and objects of the invention will become evident from the following detailed description of the drawings when read in connection with the accompanying drawings which illustrate preferred embodiments of the invention.

DETAILED DESCRIPTION OF THE DRAWINGS

Figure 1:
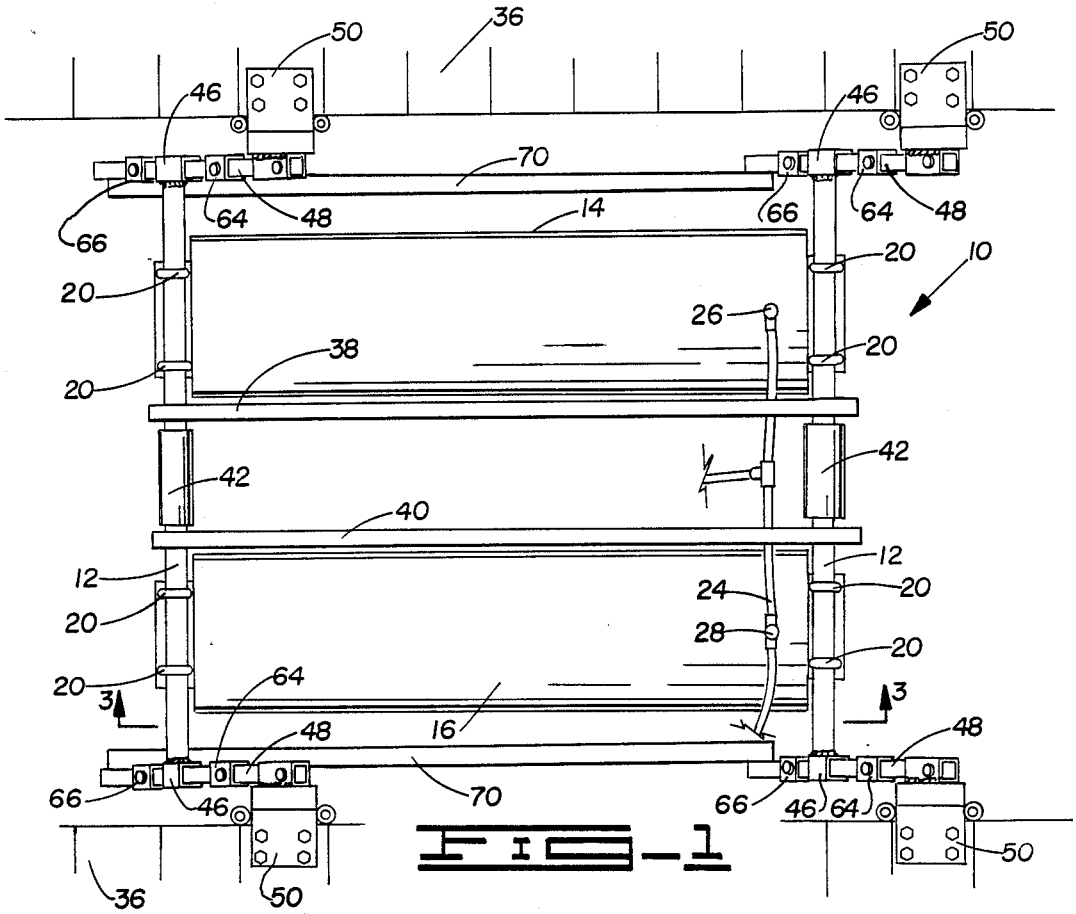
FIG. 1 is a top view of the boat lift attached to parallel dock sides.

In FIG. 1 the boat lift is designated by general reference numeral 10. The lift 10 includes a pair of tank support cross members 12 which if desired, may be telescoping for various widths of boat docks. A pair of tanks 14 and 16 are attached to the cross members 12 by a pair of braces 17 which are welded to ends 18 of the tanks with the top of the braces 17 secured to the cross members by clamps 20. The tanks are further secured to each other by a horizontal brace 22 shown in FIG. 2.

Figure 2:
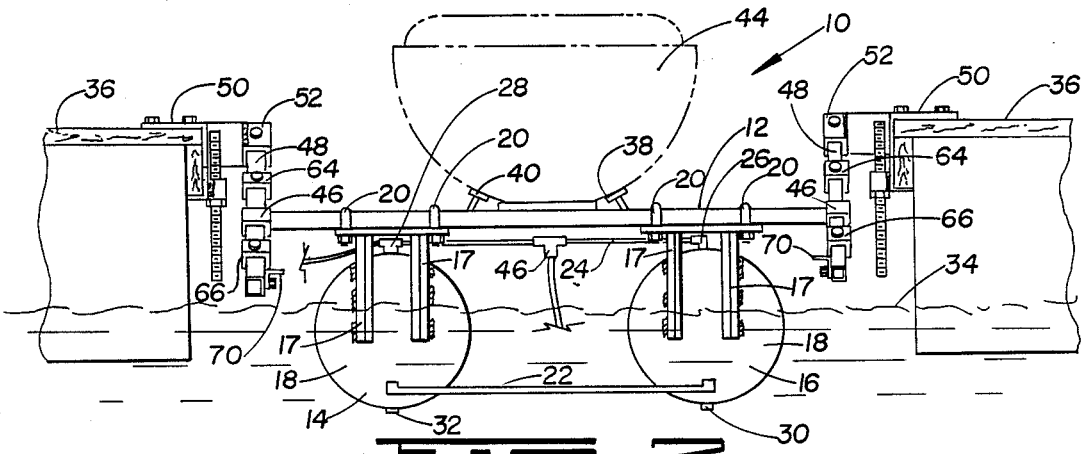
FIG. 2 is a front view of the boat lift with the boat received thereon and shown in dotted lines.

The tanks 14 and 16 include an air pressure hose 24 connected to tank valves 26 and 28 for use with a standard air pressure pump, not shown in the drawings, for introducing air under pressure into the tanks and discharging the water therein out tank valves 30 and 32 shown in the bottom of the tanks in FIG. 2. By introducing air, under pressure, into the tanks and discharging the water, the boat lift 10 is raised above a water level 34.

In FIG. 1 it should be noted the lift 10 is disposed in a boat slip between a pair of spaced apart parallel dock sides 36. While the parallel dock sides 36 should be parallel to each other quite often because of the movement of the dock and other irregularities, the distance from the front of the dock side and the rear of the side is not equal in width. Therefore, telescoping cross members 12 allow for proper adjustment in attachment to the dock sides 36.

Referring now to both FIG. 1 and FIG. 2 a boat support frame is shown with parallel runners 38 and 40 and center supports 42 attached to the cross members 12 for supporting a boat 44 shown in dotted lines. The lift 10 is lowered into the water by opening a valve 46 exhausting the air and allowing the water to fill the tanks. The boat 44 is then positioned while floating in the water above and between the runners 38 and 40. When air pressure is pumped into the tanks discharging the water, the lift 10 raises vertically in the slip with the runners 38 and 40 engaging the bottom of the boat and in turn raising the boat 44 above the water level 34 as shown in FIG. 2.

Figure 3:
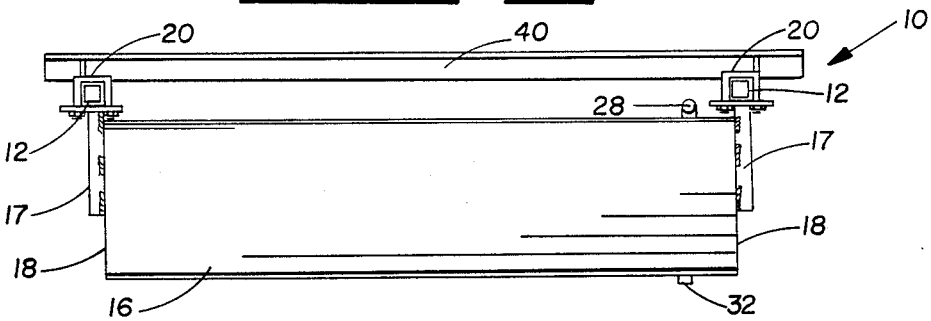
FIG. 3 is a side view of the boat lift taken along lines 3—3 shown in FIG. 1.

In FIG. 3 a side view of the boat lift 10 is taken along lines 3—3 shown in FIG. 1. In this view, the vertical braces 17 can be seen attached to the reinforced ends 18 of the cylindrical tanks 14 and 16. Shown in this Fig. is one of the elongated runners 40 used for supporting the boat 44 thereon.

Figures 4, 5:
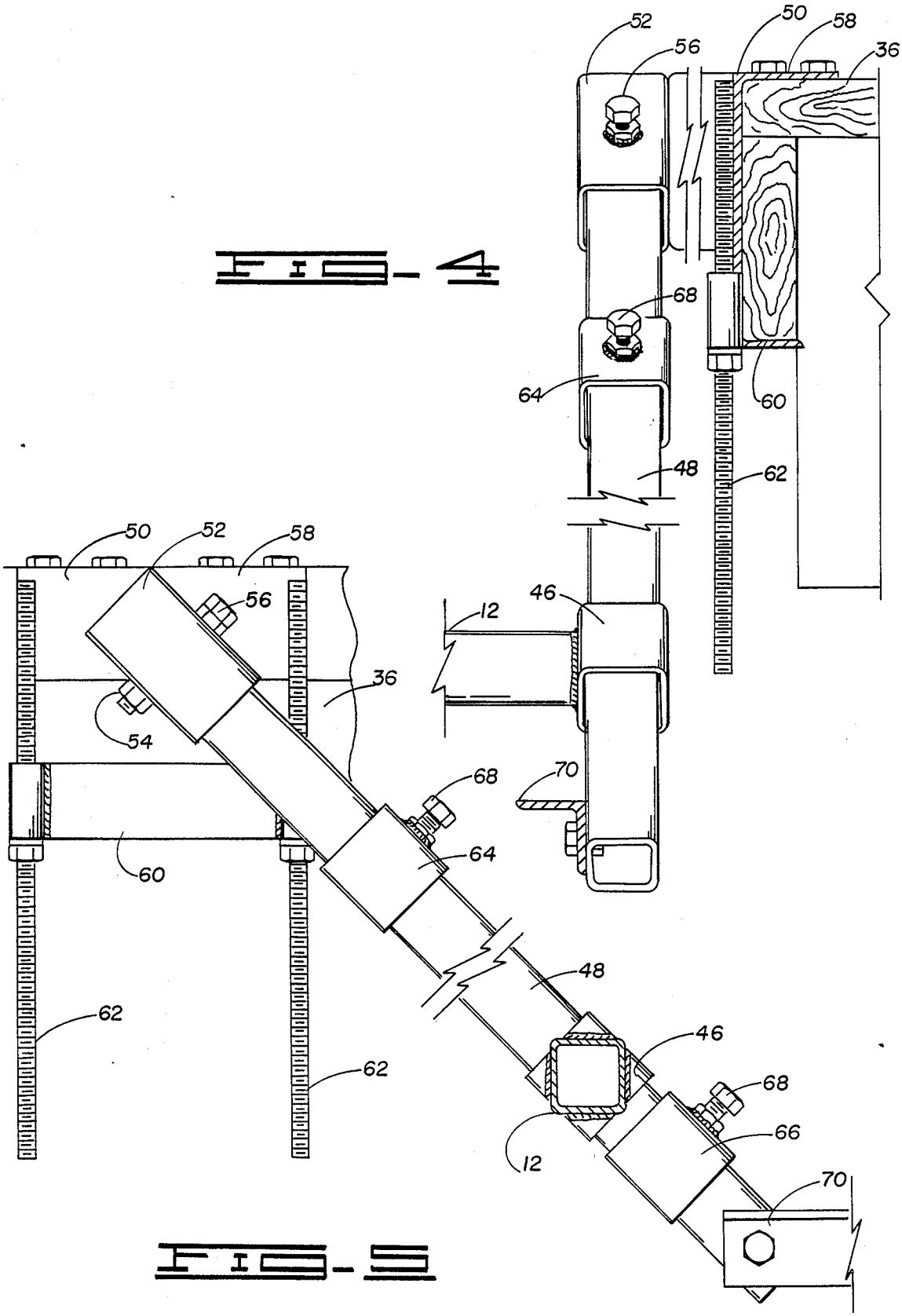
FIG. 4 and FIG. 5 is an end view and a side view of the guide arms attached to the dock side by a dock clamp.

In FIG. 4 an enlarged view of one of the cross members 12 is shown having a collar 46 mounted at opposite ends of the cross member for slidable receipt around a hollow angular shaped guide arm 48. The guide arm 48 is disposed at an angle as shown in FIG. 5 from the vertical and is secured to a dock clamp 50 by an arm holder 52. The arm holder 52 is secured to the guide arm 48 by a threaded nut 54 and bolt 56. The guide arm 48 may be positioned at an angle in a range of 20 to 70 degrees from the vertical. The arm holder 52 is secured to the dock side 36 using the dock clamp 50 having a top angle plate 58 and a separate bottom angle plate 60 adjustably attached to each other for different widths of docks using a pair of all thread rods 62.

The guide arm 48 further includes an upper guide stop 64 and a lower guide stop 66 secured thereto through the use of threaded bolts 68. The lower guide stop 66 is removed from FIG. 4 for clarity. The guide stops 64 and 66 control the distance of travel of the lift 10 as it is raised and lowered from the water. The bottom of the guide arms 48 as shown in FIGS. 1, 4 and 5 are secured together by an angular brace 70 which is parallel to the length of the dock sides 36. In effect the dock sides 36, the angular braces 70 and the guide arms 48 form a parallogram with the collars 46 of cross members 12 raised and lowered along the length of the guide arms 48.

Through the use of the guide arms 48 disposed at an angle from the vertical and the collars 46 of the cross members 12 sliding along the length thereof, the boat dock 10 can be easily raised and lowered for a more even, smooth distribution of load as the lift 10 is raised and lowered from the water surface 34.

Changes may be made in the construction and arrangement of the parts or elements of the embodiments as described herein without departing from the spirit or scope of the invention defined in the following claims.

What is claimed is:

1. A boat lift for raising and lowering a boat in a boat slip, the slip disposed between spaced apart parallel dock sides, the boat lift comprising:

a pair of cross members disposed perpendicular to the dock sides and having a boat support frame supported thereby for supporting the boat when raised, the cross members having collars attached on opposite ends thereof;

tank means attached to the cross members for supporting same at a selected height in a body of water;

means for selectively admitting compressed air into the tank means and valve means for receiving water into the tank means for alternately raising and lowering the cross members and boat support frame;

parallel guide arms attachable to the dock sides via adjustable dock clamps, the guide arms disposed at an angle from the vertical, the collars on opposite ends of the cross members sliding around the guide arms, the collars moving along the length of the guide arms as the cross members and boat support frame are raised and lowered; and guide stop means attached to each of the guide arms for controlling the distance of travel of the collars as the collars move up and down the length of the guide arms during raising and lowering of the cross members and boat support frame.

2. The boat lift as described in claim 1 further including angle braces attached to the bottom of the guide arms and parallel to the dock sides.

3. A boat lift for raising and lowering a boat in a boat slip, the slip disposed between spaced apart parallel dock sides, the boat lift comprising:

a pair of cross members disposed perpendicular to the dock sides and having a boat support frame supported thereby for supporting the boat when raised, the opposite ends of the cross members having collars attached thereto;

a pair of tanks attached to the cross members for supporting the cross members at a selected height in a body of water;

means for selectively admitting and exhausting compressed air and water to the tanks for alternately raising and lowering the cross members and boat support frame relative to the water;

parallel guide arms attached to arm holders, the arm holders attachable to a portion of the dock sides by an adjustable dock clamp, the guide arms slidably receiving the collars of the cross members, the guide arms disposed at an angle in the range of about 20 to 70 degrees from the vertical; and angle braces attached to the bottom of the guide arms and parallel to the dock sides.

* * * * *